US005323831A

United States Patent [19]

Manthei

[11] Patent Number: 5,323,831

[45] Date of Patent: Jun. 28, 1994

[54] RETENTION SYSTEM FOR OPERABLE FLEXIBLE SHADES

[75] Inventor: David Manthei, New Castle, Ind.

[73] Assignee: Draper Shade & Screen Co., Inc., Spiceland, Ind.

[21] Appl. No.: 74,222

[22] Filed: Jun. 9, 1993

[51] Int. Cl.[5] ..... E06B 9/08

[52] U.S. Cl. ..... 160/23.1; 160/264; 160/273.1

[58] Field of Search ..... 160/264, 23.1, 26, 310, 160/274, 267.1, 268.1, 273.1

[56] References Cited

U.S. PATENT DOCUMENTS

| | | | |
|---|---|---|---|
| 137,595 | 4/1873 | Clark | 160/264 |
| 1,285,547 | 11/1918 | Zimmer | 160/264 |
| 1,632,742 | 6/1927 | Minard . | |
| 3,292,685 | 12/1966 | Clark | 160/264 X |
| 3,750,740 | 8/1973 | Newman | 160/264 X |
| 4,357,978 | 11/1982 | Keller et al. | 160/41 |
| 4,398,585 | 8/1983 | Marlow | 160/23.1 |
| 4,399,855 | 8/1983 | Volfson | 160/23 R |
| 4,550,758 | 11/1985 | Johnson et al. | 160/271 |
| 4,800,946 | 1/1989 | Rosenoy | 160/264 |
| 4,945,969 | 8/1990 | Schnebly et al. | 160/84.1 |
| 4,974,658 | 12/1990 | Komatsu et al. | 160/310 |
| 5,042,866 | 8/1991 | Cody | 296/97.4 |
| 5,088,543 | 2/1992 | Bilbrey | 160/310 |
| 5,099,905 | 3/1992 | Rigter | 160/264 X |
| 5,131,450 | 7/1992 | Lichy | 160/310 |
| 5,141,043 | 8/1992 | Kraeutler | 160/264 |

FOREIGN PATENT DOCUMENTS

| | | | |
|---|---|---|---|
| 143864 | 12/1935 | Fed. Rep. of Germany | 160/264 |
| 2232655 | 1/1975 | France | 160/264 |

OTHER PUBLICATIONS

Lite-Lock Lightproof Shade, product brochure, Draper Shade & Screen Co., Inc. (1 page).

FlexShade Components, product brochure, Draper Shade & Screen Co., Inc. (1 page).

*Primary Examiner*—Blair M. Johnson

*Attorney, Agent, or Firm*—Baker & Daniels

[57] ABSTRACT

A retention system for operable flexible shades. The system includes a flexible sheet of a size which substantially covers a wall opening, and which is connected at its top edge to an operable roller. A side casing having a channel is mounted at each side edge of the wall opening. A plurality of generally parallel stays is applied to one of the opposing surfaces of the sheet for providing rigidity to the sheet, and to assist in keeping the edges of the sheet within the channels when a positive pressure is applied to the sheet. A grommet sized to remain within a channel during the rolling and unrolling of the sheet is affixed at each end of at least some of the stays.

22 Claims, 4 Drawing Sheets

RETENTION SYSTEM FOR OPERABLE FLEXIBLE SHADES

FIELD OF THE INVENTION

This invention relates to operable flexible shade systems, and, in particular, to a shade and a system for retaining an operable flexible shade within the system's side casings.

BACKGROUND OF THE INVENTION

There are many instances in which it may be desirable to eliminate or reduce light from entering a room through a window or a skylight. A dark room, a conference room utilized for film viewing, or a chemical laboratory in which a light-sensitive experiment is to be conducted are just a few examples of the applications of operable flexible shade systems. Typically, the shades of operable shade systems are unrolled from a roller residing within a top casing affixed to the top of the wall opening (window, skylight and the like) and the sides of the shade are slidably movable within channels formed by the side casings of the shade system. The side casings are affixed to the sides of the wall opening. The channels in the side casings guide the shade when being raised or lowered and also assist in making certain that the shade, when fully lowered, results in complete coverage of the wall opening.

Numerous variations in commercially available operable shade systems are known in the art. The system's roller may be actuated by an electric motor disposed within the top casing, a manually operated crank, or a bi-directional clutch having a chain affixed thereto. The shade may be comprised of various materials having varied textures and light admitting properties. In this manner, the wall opening may be made opaque, semi-transparent, or transparent when covered by such a shade. Representative of operable shade systems are the FlexShade Systems, both motorized and manually operated, available from Draper Shade and Screen Co., Inc. of Spiceland, Ind.

For many installations of operable shade systems, and especially for those installations in which a positive pressure may exist in the room having the wall opening to be covered by the shade, a retention system is provided to ensure that the edges of the shade remain within the channels of the side casings when reasonable pressure is applied to the shade. In one such retention system, horizontally oriented spring steel stays of a length less than the width of the shade are affixed to the shade at spaced intervals along the length of the shade. Specifically, each stay is attached to the shade with a double-sided adhesive, and a fabric covering having dimensions slightly greater than that of the stay is attached to the shade and the stay by use of a double-sided adhesive tape. Another known retention system utilizes grommets which are inserted through the shade along the shade's side edges at spaced intervals.

For both the above-described prior art retention systems, the edges of the shade are placed within channels in side casings installed in the wall opening. This provides some assurance that the shade will cover the opening in the event that pressure is applied to the shade. However, if significant force is applied to either retention system, the edges of the shade have been known to come out of the channels, thereby defeating the purpose of the shade by allowing light to pass through the edges of the shade. For example, the edges of a shade using the steel stay retention system may slip out of the channels if the stays are bent a substantial amount, and the fabric of a shade having grommets on the shade's edges may actually be torn when pressure is applied to the shade, thereby allowing the shade to become free of the channels. Therefore, it is desirable to provide a retention system for such shades which is better able to withstand the application of a force to the shade by ensuring that the edges of the shade remain within the side channels.

A retention system having steel stays is further disadvantageous because the number of stays required to secure an unrolled shade within the side channels results in a rolled shade which is of a diameter which may require the use of a larger top casing than may be desirable. Further, affixing the stays and fabric coverings to the shade by an adhesive may permit the stays to become dislodged from beneath the fabric covering. The retention system having grommets presents another problem as the fabric must be punctured for the introduction of the grommets into the shade. This weakens the shade's fabric and may tear the fabric near each grommet. Therefore, it is desirable to provide a retention system for flexible shades which reduces the size of the shade when rolled and which does not weaken the shade's fabric at various points along the edges of the shade. It is also desirable to reduce the manufacturing costs of the shade system when compared to prior art.

Yet another problem associated with the shade systems using either stays or grommets is the width of the channel required to secure the edges of the shade within the channel. Typically, the greater the width of the shade, the wider the channels must be. For example, a three (3) inch channel width may be required for shade widths of up to 72 inches, a four (4) inch channel width may be required for shade widths from 72 inches to 96 inches, and a five (5) inch channel width may be required for shade widths greater than 96 inches. The channel width's dependence on shade width is based in part on the retention system's resistance to positive pressure coupled with the limitation on the number of grommets or stays that may be utilized without adversely affecting the diameter of a completely rolled screen. Wide channels necessitate wide side casings which detract from the appearance of the window or skylight in which the shade is installed and also limit the amount of light entering the window or skylight when the shade is completely rolled up and not in use. It is therefore desirable to provide a retention system which utilizes narrower channels than that required for the prior art and which can be used with a constant channel width over a greater range of shade lengths.

SUMMARY OF THE INVENTION

The present invention provides a flexible shade for use with an operable shade system and an operable flexible shade system using such a shade. A retention system is provided to allow the shade's edges to remain within the side casings of the system, mounted to the sides of a wall opening, upon the application of pressure to the shade.

The invention comprises, in one form thereof, a flexible shade for use with an operable shade system for disposition within a wall opening having top and bottom edges and first and second opposing edges. The operable shade system includes an operable roller and first and second side casings mounted to the respective first and second opposing edges of the wall opening, each side casing having a channel therein. The shade of the system includes a flexible sheet of a size which at least substantially covers the wall opening, and the sheet has a top edge for connection to the roller, a bottom edge opposite the top edge, first and second opposing edges defining the width of the sheet therebetween, and first and second opposing surfaces. Secured to one of the opposing surfaces of the sheet are a plurality of stays. Each stay has a first end and a second end, is aligned generally parallel to the top and bottom edges of the sheet, and is at least substantially as long as the width of the sheet. The shade also includes a grommet affixed to each end of at least some of the stays.

In another form thereof, the invention comprises an operable flexible shade system including the flexible shade of the present invention, an operable roller mounted at the top edge of the wall opening, and first and second side casings attached to the respective first and second edges of the wall opening, with each side casing having a channel therein. Each grommet of the shade is sized such that the grommet remains within a channel during the operation of the roller.

Accordingly, one advantage of the present invention is the provision of a flexible shade for an operable flexible shade system whose side edges remain within the system's side casings despite the application of pressure to the shade.

Another advantage of the present invention is the provision of a flexible shade for an operable flexible shade system which is less expensive to manufacture than prior art systems.

Yet another advantage of the present invention is the ability to reduce the diameter of a rolled flexible shade when the shade is used with an operable flexible shade system.

Still another advantage of the present invention is the provision of retention system which is not inclined to tear the fabric of the shade.

Another advantage of the present invention is the provision of a retention system which requires narrower channel widths in the side casings and in which the required channel width is applicable over a wider range of shade widths than the prior art systems.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out therein illustrate preferred embodiments of the invention, and such exemplifications are not to be construed as limiting in any manner.

DETAILED DESCRIPTION

Figure 1:
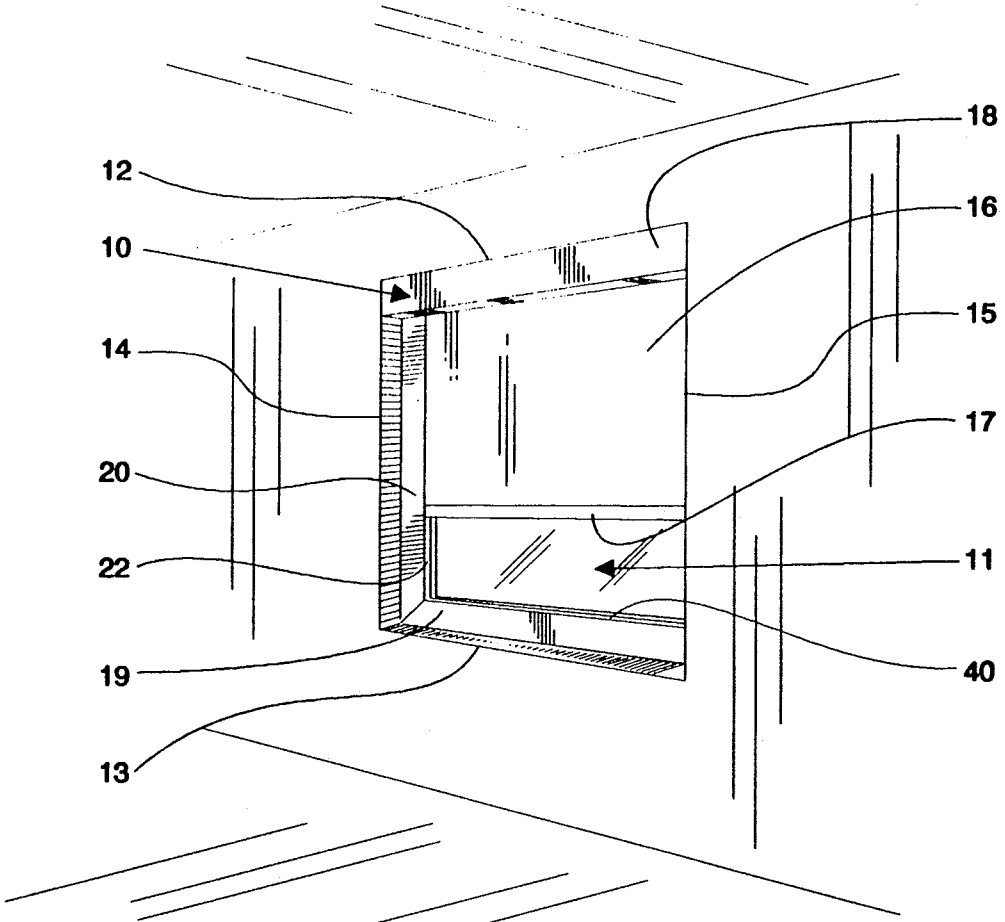
FIG. 1 shows a perspective view of one embodiment of an operable flexible shade system.

Referring now to FIG. 1, there is shown a perspective view of one embodiment of an operable flexible shade according to the present invention. Operable shade system 10 is installed within wall opening 11, illustrated here as a window. Wall opening 11 has top edge 12, bottom edge 13 opposite top edge 12, and first and second opposing edges 14 and 15. Operable shade system 10 includes top casing 18, bottom casing 19, first and second side casings 20 and 21 (see FIG. 2), each casing mounted to the respective edge of wall opening 11, and a shade including sheet 16. Flexible sheet 16 is raised and lowered from top casing 18 such that the edges of sheet 16 (see FIG. 2) are slidably movable within first channel 22 of first casing 20 and second channel 23 of second casing 21 (see FIGS. 2 and 5). In this embodiment, the bottom edge of sheet 16 is defined by weight bar 17 which, when sheet 16 is fully lowered to engage bottom casing 19, resides within bottom channel 40 of bottom casing 19. Sheet 16 is sized to substantially cover wall opening 11.

Figure 2:
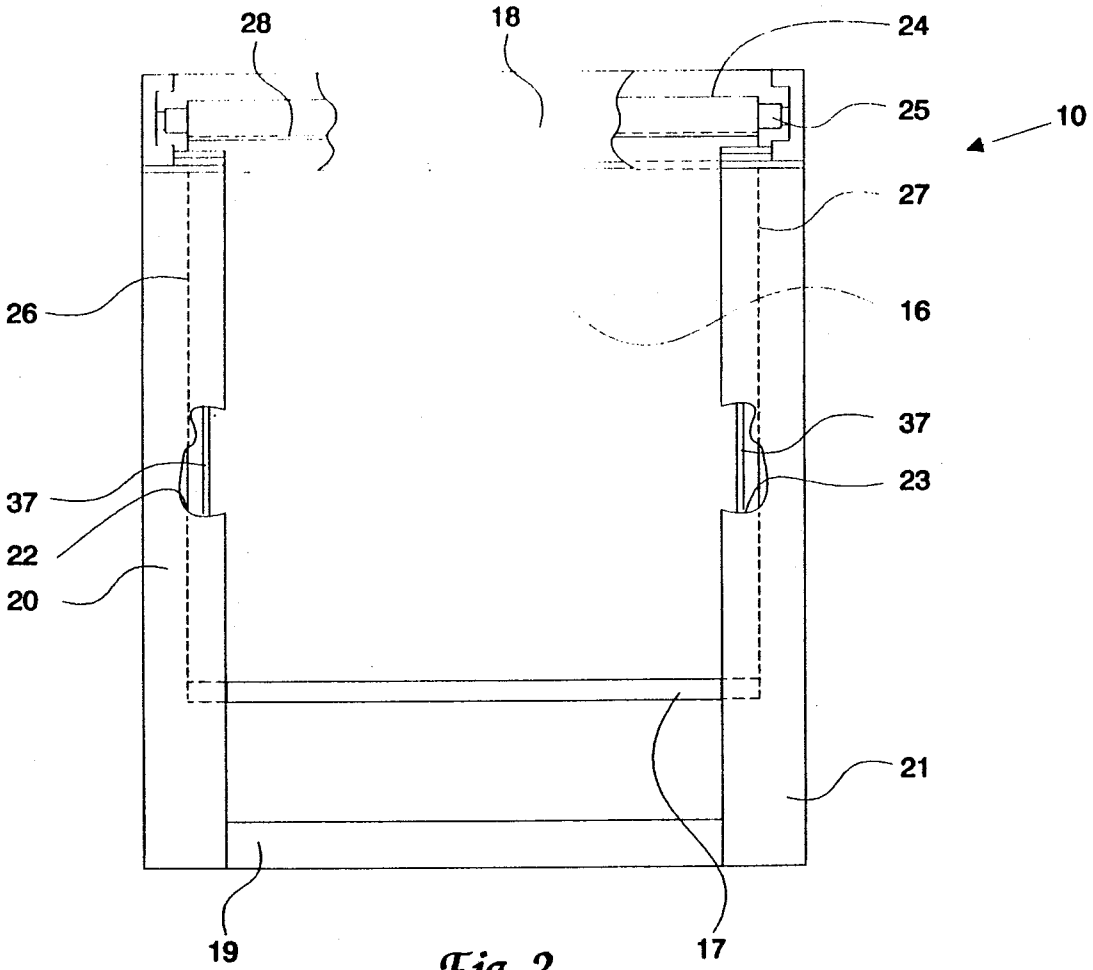
FIG. 2 shows a partial cut-away view of the operable flexible shade system of the embodiment of FIG. 1.

FIG. 2 shows a partial cut-away view of the operable flexible shade system of the embodiment of FIG. 1. In this embodiment, top edge 28 of sheet 16 is attached to roller 24. Roller 24 is operatively connected to motor 25 such that roller 24 rotates about its longitudinal axis in response to the operation of motor 25. In this manner, rotation of roller 24 by motor 25 causes sheet 16 to be raised and lowered with respect to top casing 18. Thus, sheet 16 is movable between a rolled condition in which sheet 16 is rolled about roller 24 and an unrolled condition in which sheet 16 substantially covers wall opening 11.

It will be appreciated by those of skill in the art that wall opening 11 need not be restricted to comprise a window as illustrated in FIG. 1. The wall opening may comprise a skylight or any other opening in a wall, ceiling and the like. It will also be appreciated that other mechanisms, such as a hand crank or a bi-directional clutch, may be utilized for raising and lowering the shade, and that such mechanisms are within the scope of the invention disclosed herein.

Figure 3:
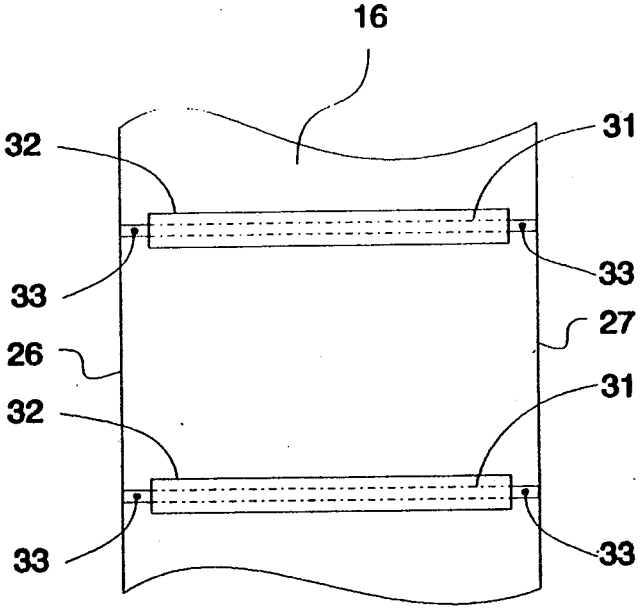
FIG. 3 shows a front view of one embodiment of a flexible shade according to the present invention.

FIG. 3 shows a front view of one embodiment of a flexible shade according to the present invention. In this embodiment, the shade includes sheet 16, stays 31, fabric strips 32, and grommets 33. Specifically, vertically spaced along the length of sheet 16 on one of the opposing (front or back) surfaces of sheet 16 are a plurality of spring steel stays 31. In the embodiment of FIG. 3, stays 31 extend to opposing side edges 26 and 27 of sheet 16, i.e., the width of sheet 16, and are aligned generally parallel with top and bottom edges 28 and 17 (see FIG. 2) of sheet 16. Stays 31 may comprise, for example, 1075–1095 blue tempered and polished spring steel of approximately 0.005 to 0.030 inch in thickness. In a preferred embodiment, stays 31 have a thickness of 0.015 inch. At each end of each stay 31 is grommet 33 which is inserted through stay 31 and sheet 16 at each of the opposing ends of stays 31. Thus, stays 31 are secured to sheet 16 by way of grommets 31. In this embodiment, stays 31 are each substantially covered with fabric covering 32 in the form of a strip for aesthetic reasons and to result in a smoother surface for rolling and unrolling sheet 16. Fabric covering 32 does not cover grommets 33 and is adhered to sheet 16 and stay 31 with an appropriate fastener, such as double-sided adhesive tape.

Unlike a prior art embodiment in which stays alone were utilized to retain sheet 16 within side casings 20 and 21, stay 31 according to the present invention is secured to sheet 16 via grommets 33. Specifically, stays 31 are more rigidly secured to sheet 16 than are the stays of the prior art wherein stays are secured to the shade by use of an adhesive. As a result, stays 31 of the present invention are not prone to becoming unattached from the shade during rolling and unrolling of the sheet 16, and, more importantly, the combination of stays 31 adding rigidity to sheet 16 together with grommets 33 slidably movable within side casings 20 and 21 is able to withstand the application of greater pressure to sheet 16 without pulling first and second opposing edges 26 and 27 of sheet 16 from outside casings 20 and 21, respectively. Also, because grommets 33 are inserted through both sheet 16 and stay 31, grommets 33 are less likely to weaken or tear the fabric of sheet 16 than are known systems wherein grommets alone are used. Further, due to the fact that sheet 16 is able to withstand greater pressures exerted thereon without causing sheet 16 to be pulled from side casings 20 and 21, it has been demonstrated that stays 31 of FIG. 3 may be spaced further apart than when used without grommets 33 and that stays 31 of FIG. 3 may be made of a thinner material (about 0.005 to about 0.030 inch in thickness) than stays used without grommets 33.

It will be appreciated by those of skill in the art that overall costs associated with manufacture of the shade illustrated in FIG. 3 are less than those for a shade which simply utilizes stays adhesively affixed to a shade. Though the implementation of grommets together with the stays increases some costs, the increase in cost is offset by the fact that fewer stays and stays of lesser thickness may be used together with the elimination of an adhesive between the stays and the shade.

The implementation of grommets together with the stays provides an arrangement that is better able to withstand the application of pressure to the shade than are the use of either stays or grommets alone. In the embodiment of FIG. 3, the stays resist the deformation of the shade, and the grommets and stays resist movement of the edges of the shade from within the channels of the side casings.

The use of stays in conjunction with the grommets is advantageous over the use of grommets alone for many of the same reasons the combination is advantageous over the use of stays alone. Further, because the grommets are securely fastened through the stays in addition to the shade's fabric, the grommets are not likely to tear the shade's fabric, either during installation of the grommets or upon the application of pressure to the shade when the edges of the shade reside within an operable shade system's side casings.

Figure 4:
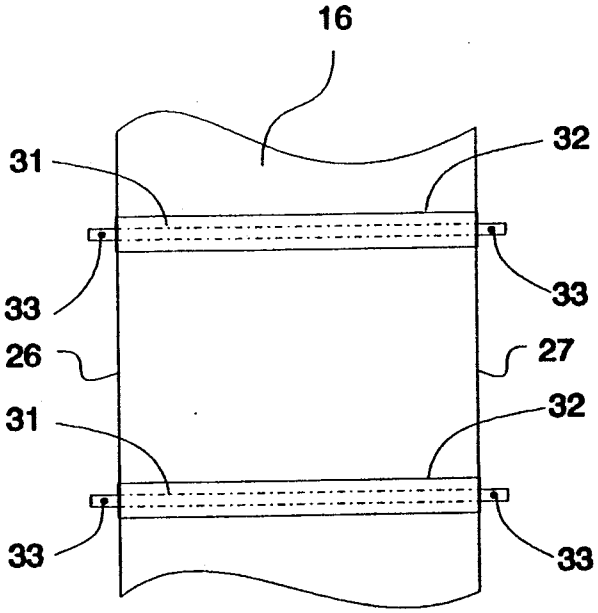
FIG. 4 shows a front view of a second embodiment of a flexible shade according to the present invention.

Referring to FIG. 4, there is shown a front view of a second embodiment of a flexible shade according to the present invention. In this embodiment, stays 31 are secured to sheet 16 at spaced intervals along the length of sheet 16 with an appropriate fastener, such as a double-sided adhesive tape. The ends of stays 31 extend beyond side edges 26 and 27 of sheet 16. As in the embodiment of FIG. 3, grommet 33 is inserted in each end of each stay 31. In this embodiment, grommets 33 are not, however, inserted through the fabric of shade 16. For aesthetic reasons and to result in a smoother shade surface, stay 31 is substantially covered with fabric covering 32 extending the entire width of sheet 16 (extending between opposing side edges 26 and 27 of sheet 16). Fabric covering 32 may be affixed with a double-sided adhesive tape to both sheet 16 and stay 31.

As in the embodiment of FIG. 3, stays 31 of FIG. 4 may be made of thinner material than when used without grommets 33. For example, spring steel stays of only 0.015 inch in thickness may be used with the embodiment of FIG. 4 where spring steel stays of a like composition of 0.060 inch in thickness may be required for prior art systems. Also, because grommets 33 are not inserted through sheet 16, the likelihood of weakening or tearing the fabric of sheet 16 is minimized. As with the embodiment of FIG. 3, fewer stays 31 are required than are required in the prior art embodiments wherein stays alone are utilized to ensure that sheet 16 remains within the channel. Finally, sheet 16 of FIG. 4 may be slightly narrower than the shades of the prior art wherein grommets alone or stays alone are used. Consequently, overall manufacturing costs of the system may be reduced by the use of fewer, thinner stays, and a narrower shade, offsetting the increase in cost introduced by the implementation of stays and grommets in combination when compared to the implementation of either stays or grommets alone.

Figure 5:
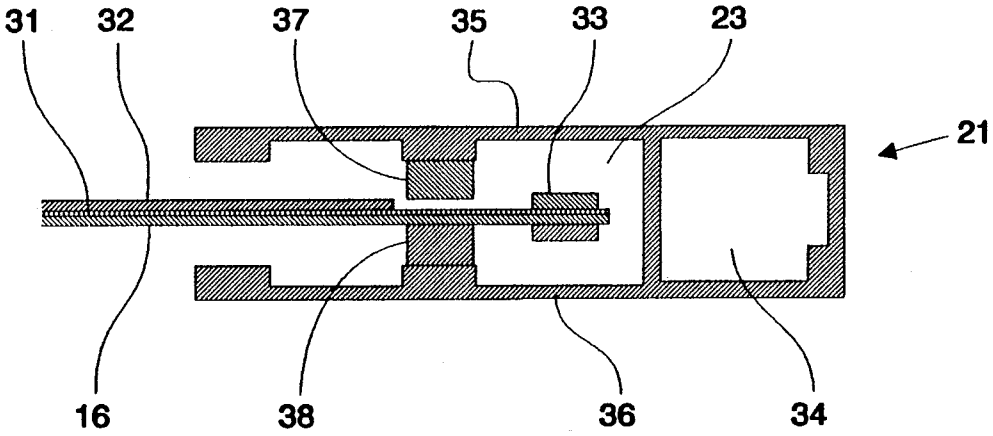
FIG. 5 shows a top cross-sectional view of one embodiment of the side casing of an operable shade system utilizing the flexible shade of FIG. 3.

FIG. 5 shows a top cross-sectional view of a side casing of an operable shade system used to secure the edges of the embodiment of the shade of FIG. 3. Second side casing 21 serves each embodiment of the present invention and in this illustration, the shade, including sheet 16, stays 31, fabric coverings 32 and grommets 33, utilizes the retention system of FIG. 3. Second side casing 21 may be divided into two separate channels 23 and 34—internal channel 34 for the provision of additional clearance for sheet 16 and second channel 23 for the insertion of second side edge 27 of shade 16 therein. Attached to first and second opposing surfaces 35 and 36 of second side casing 21 are first and second fabric retainers 37 and 38, respectively. As shown in FIG. 5, fabric retainers 37 and 38 define a border for second channel 23 and are arranged such that fabric retainers 37 and 38 define a space therebetween. Second edge 27 of sheet 16 extends into second channel 23 past the border defined by retainers 37 and 38 and in the space between retainers 37 and 38. Grommet 33 is of a larger dimension than the space between fabric retainers 37 and 38 such that grommet 33 is maintained within second channel 23 when sheet 16 is unrolled, even when pressure is applied to one of the opposing surfaces of sheet 16. The fabric retainers are of a material which substantially retards the removal of the sheet from the channels by interengagement between the grommets and the fabric retainers. Thus, first and second fabric retainers 37 and 38 and grommet 33 collectively serve as a means for retaining stay 31 within second channel 23 of second side casing 21. In this embodiment, the retaining means also assists in retaining second edge 27 of sheet 16 within second channel 23. Similarly, grommets 33 positioned in first channel 22 of first side casing 21 are sized to be maintained within first channel 22 when sheet 16 is in its unrolled condition.

It will be appreciated by those of skill in the art that the retention system of the present invention results in a side casing 21 having a narrower channel than is required for use with the prior art. The rigidity of the shade provided by stays 31 coupled with the use of grommets 33 is more resistive to positive pressure applied to the shade than is known in the art. Therefore, the present invention does not necessitate a channel width of the same magnitude as that of prior art systems as the width of the channel in the prior art accommodates the edges of the shade by providing room to compensate for the shade's flexibility. It has also been demonstrated that the resistivity of the shade to pressure applied thereon allows side casings having a channel of a particular width to be used for a wide range of shade widths. Whereas, prior art channels may typically be three (3) inches in width for shade widths up to 72 inches, four (4) inches for shade widths from 72 inches to 96 inches, and five (5) inches for shade widths greater than 96 inches, second casing 21 may be approximately 2.75 inches for shades of virtually any width, including those beyond 96 inches.

While this invention has been described as having preferred designs, the present invention can be further modified within the spirit and scope of this disclosure. This application is therefore intended to cover any variations, uses or adaptations of the invention using its general principles. Further, the application is intended to cover such departures from the present disclosure as come within known or customary practice in the art to which this invention pertains and which falls within the limits of the appended claims.

What is claimed is:

1. A shade for use with an operable shade system of the type including an operable roller for rolling and unrolling the shade, and first and second side casings affixed to a wall opening, each side casing having a channel therein, the shade comprising:

a flexible sheet of a size which substantially covers the wall opening, the sheet having a top edge for connection to the roller, a bottom edge opposite the top edge, first and second opposing edges for disposition within the channels of the side casings when the shade is unrolled, the first and second opposing edges defining the width of the sheet therebetween, and first and second opposing surfaces;

a plurality of stays, each stay having a first end and a second end, and being secured to one of the opposing surfaces of the sheet, each of the stays being aligned generally parallel to the top and bottom edges of the sheet and being of a length longer than the width of the sheet; and a grommet affixed at each end of at least some of the stays beyond the respective edge of the sheet, the grommets being positioned such that the grommets affixed to the first ends of respective stays are disposed within the channel of the first side casing, and the grommets affixed at the second ends of the respective stays are disposed within the channel of the second side casing when the shade is unrolled.

2. The shade of claim 1, further comprising:

a flexible strip, the strip fastened to the sheet such that the strip substantially covers one of the stays while leaving the grommets affixed to the ends of the stay uncovered.

3. The shade of claim 1, wherein a grommet is affixed at each end of each of the stays.

4. The shade of claim 1, wherein the stays are comprised of spring steel.

5. A flexible shade system for disposition within a wall opening having top and bottom edges and first and second opposing edges, the system comprising:

an operable roller mounted at the top edge of the wall opening;

first and second side casings attached to the respective first and second edges of the wall opening, each side casing having a channel therein and having first and second opposing surfaces; and a shade comprising:

a flexible sheet, the sheet having a top edge connected to the roller and being movable between a rolled condition and an unrolled condition, the sheet further including a bottom edge opposite the top edge, first and second opposing edges for disposition within the channels of the side casings when the sheet is in the unrolled condition, the first and second opposing edges defining the width of the shade therebetween, and first and second opposing surfaces, a plurality of stays, each stay having a first end and a second end, and being secured to one of the opposing surfaces of the sheet, the stays being aligned generally parallel to the top and bottom edges of the sheet and being sized such that the first end extends into the channel of the first side casing and the second end extends into the channel of the second side casing when the sheet is in the unrolled condition; and means for retaining the ends of at least some of the stays within the respective channel when the sheet is in the unrolled condition, the retaining means comprising;

first and second opposing fabric retainers, the first fabric retainer being connected to the first surface of the side casing and the second fabric retainer being connected to the second surface of the side casing, the first and second opposing fabric retainers defining a border for the channel and being arranged such that a space is defined therebetween wherein the first and second edges of the sheet extend into the channels through the space, and a grommet affixed to each end of at least some of the stays and disposed within a respective channel, the grommets being larger than the space between the fabric retainers so that the grommets are maintained in the channels when the sheet is in the unrolled condition, said fabric retainers being of a material to substantially retard the removal of the sheet from the channels by interengagement between the grommets and the fabric retainers.

6. The system of claim 5, further comprising:

a motor operatively connected to the roller such that the roller rotates about its longitudinal axis in response to the operation of the motor.

7. The system of claim 6, further comprising:

a top casing mounted to the top edge of the wall opening, the top casing housing the roller and the motor; and a bottom casing mounted to the bottom edge of the wall opening, the bottom casing having a channel therein for receipt of the bottom edge of the sheet.

8. The system of claim 5, wherein each stay is substantially the same length as the width of the sheet and wherein the grommet is also affixed at the edge of the sheet.

9. The system of claim 5, wherein each stay is longer than the width of the sheet such that the grommet is affixed to the stay beyond the respective edge of the sheet.

10. The system of claim 5, further comprising:

a flexible strip, the strip fastened to the sheet such that the strip substantially covers one of the stays while leaving the grommets affixed to the ends of the stay uncovered.

11. The system of claim 5, wherein a grommet is affixed at each end of each of the stays.

12. The shade of claim 5, wherein the stays are comprised of spring steel.

13. The system of claim 12, wherein the stays have a thickness from about 0.005 inch to about 0.030 inch.

14. A flexible shade system for disposition within a wall opening having top and bottom edges and first and second opposing edges, and having a roller mounted at the top edge of the wall opening, the system comprising:

first and second side casings attached to the respective first and second edges of the wall opening, each side casing having first and second opposing surfaces and a channel disposed between the opposing surfaces, each side casing further including first and second opposing fabric retainers disposed between the opposing surfaces of the side casing, the first fabric retainer being connected to the first surface and the second fabric retainer being connected to the second surface, the first and second opposing fabric retainers defining a border for the channel and being arranged such that a space is defined between the fabric retainers; and a shade comprising a flexible sheet, the sheet having a top edge connected to the roller and capable of being deployed between a rolled condition wherein the sheet is rolled about the roller and an unrolled condition wherein the sheet substantially covers the wall opening, a bottom edge opposite the top edge, first and second opposing edges for disposition through the space and within the channels of the side casings when the sheet is in the unrolled condition, the first and second opposing edges defining the width of the shade therebetween, and first and second opposing surfaces, a plurality of stays, each stay having a first end and a second end, and being secured to one of the opposing surfaces of the sheet, the stays being aligned generally parallel to the top and bottom edges of the sheet and being sized such that the first end extends through the space and into the channel of the first side casing and the second end extends through the space and into the channel of the second side casing when the sheet is in the unrolled condition; and a grommet affixed to each end of at least some of the stays and being positioned such that each grommet is disposed within the channel of a respective side casing when the sheet is in the unrolled condition, the grommets being of larger dimension than the space between the fabric retainers such that the grommets and the ends of the stays affixed to the grommets are retained within the channel when the sheet is in the unrolled condition, said fabric retainers being of a material to substantially retard the removal of the sheet from the channels by interengagement between the grommets and the fabric retainers.

15. The system of claim 14, further comprising:

a motor operatively connected to the roller such that the roller rotates about its longitudinal axis in response to the operation of the motor.

16. The system of claim 15, further comprising:

a top casing mounted to the top edge of the wall opening, the top casing housing the roller and the motor; and a bottom casing mounted to the bottom edge of the wall opening, the bottom casing having a channel therein for receipt of the bottom edge of the sheet.

17. The system of claim 14, wherein each stay is substantially the same length as the width of the sheet and wherein the grommet is also affixed at the edge of the sheet.

18. The system of claim 14, wherein each stay extends beyond the width of the shade such that the grommet is affixed to the stay beyond the respective edge of the sheet.

19. The system of claim 14, further comprising:

a flexible strip, the strip fastened to the sheet such that the strip substantially covers one of the stays while leaving the grommets affixed to the ends of the stay uncovered.

20. The system of claim 14, wherein a grommet is affixed at each end of each of the stays.

21. The system of claim 14, wherein the stays are comprised of spring steel.

22. The system of claim 21, wherein the stays have a thickness from about 0.005 inch to about 0.030 inch.

* * * * *